US011702254B2

(12) United States Patent
Lee

(10) Patent No.: US 11,702,254 B2
(45) Date of Patent: Jul. 18, 2023

(54) LOCKING MECHANISM FOR CONTAINER AND LID THEREOF

(71) Applicant: Chen-Hsuan Lee, Taichung (TW)

(72) Inventor: Chen-Hsuan Lee, Taichung (TW)

( * ) Notice: Subject to any disclaimer, the term of this patent is extended or adjusted under 35 U.S.C. 154(b) by 0 days.

(21) Appl. No.: 17/535,807

(22) Filed: Nov. 26, 2021

(65) Prior Publication Data

US 2023/0166891 A1 Jun. 1, 2023

(51) Int. Cl.
*B65D 43/02* (2006.01)

(52) U.S. Cl.
CPC .... *B65D 43/0249* (2013.01); *B65D 2543/005* (2013.01); *B65D 2543/0074* (2013.01); *B65D 2543/00092* (2013.01); *B65D 2543/00537* (2013.01); *B65D 2543/00555* (2013.01); *B65D 2543/00629* (2013.01); *B65D 2543/00694* (2013.01); *B65D 2543/00805* (2013.01)

(58) Field of Classification Search
CPC ..... B65D 43/0249; B65D 43/0237; B65D 2543/005; B65D 2543/00361
See application file for complete search history.

(56) References Cited

U.S. PATENT DOCUMENTS

| | | | | |
|---|---|---|---|---|
| 9,828,149 | B2 * | 11/2017 | Wang | B65D 43/0254 |
| 2009/0159607 | A1 * | 6/2009 | Kratzer | B44D 3/128 220/849 |
| 2009/0206082 | A1 * | 8/2009 | Vovan | B65D 43/0249 29/428 |
| 2017/0057706 | A1 * | 3/2017 | Wang | B65D 43/0254 |
| 2017/0107031 | A1 * | 4/2017 | Hsieh | B65D 43/14 |
| 2017/0121080 | A1 * | 5/2017 | Wang | B65D 43/0254 |
| 2018/0141731 | A1 * | 5/2018 | Hsieh | B65D 43/26 |

* cited by examiner

*Primary Examiner* — Jeffrey R Allen
(74) *Attorney, Agent, or Firm* — Che-Yang Chen; Law Office of Michael Chen

(57) ABSTRACT

A locking mechanism for container and lid thereof may include a container and a lid, and the peripheral edge of the upper opening of the container has a first periphery edge. At least two first coupling portions, which are located at symmetric positions, and at least two second coupling portions, which are located at symmetric positions, outwardly protrude from the first periphery edge respectively. The lid comprises a second peripheral edge at the outer periphery thereof, and the inner surface of the second peripheral edge is configured to couple with and cover the first peripheral edge of the container. At least two first connecting portions respectively protrude from the second peripheral edge at symmetric positions, and at least two second connecting portions, which are located at symmetric positions, outwardly protrude from the second periphery edge respectively.

8 Claims, 14 Drawing Sheets

LOCKING MECHANISM FOR CONTAINER AND LID THEREOF

FIELD OF THE INVENTION

The present invention relates to a locking mechanism and more particularly to a locking mechanism for container and lid thereof.

BACKGROUND OF THE INVENTION

The conventional container comprises a lid to seal the container so as to store food, and, generally, the lid has a top portion, and an extending portion is extended downwardly from the outer edge of the top portion so as to couple and cover the upper edge of the container. Thus, the lid is engaged with and seals the container.

However, the conventional locking mechanism for container and lid thereof has following disadvantages: (i) the lid covers the container through coupling the lateral of the upper edge of the container, and although the edge of the lid has engaging pieces to engage with the upper edge of the container, the lid cannot firmly cover and couple with the container in case that the lid or the container is pressed and deformed; and (ii) the conventional engagement mechanism may result that the user cannot tell whether the lid has been opened by intentional persons after closed, so as to cause risk; and (iii) the conventional engagement mechanism is time-consuming and inconvenient for the user in engagement and disengagement. Therefore, there remains a need for a new and improved design for a locking mechanism for container and lid thereof to overcome the problems presented above.

SUMMARY OF THE INVENTION

The present invention provides a locking mechanism for container and lid thereof comprising a container and a lid, and the peripheral edge of the upper opening of the container has a first periphery edge. At least two first coupling portions, which are located at symmetric positions, and at least two second coupling portions, which are located at symmetric positions, outwardly protrude from the first periphery edge respectively. The outer edge of the first coupling portion has a first hinge portion, and a first bending portion is formed between the first coupling portion and the first hinge portion. The first hinge portion comprises a second engaging protrude on the surface thereof, and a first cutting broken line is formed on the first hinge portion around the outer periphery of the second engaging protrude. Each of the second coupling portions has a second hinge portion formed at the outer edge thereof, and a second bending portion is formed between the second coupling portion and the second hinge portion. Each of the second coupling portions comprises a coupling protrude at the middle section thereof, and two coupling recesses are respectively formed at two lateral sides of the coupling protrude. Each of the second hinge portions has a first engaging portion protruding from the surface thereof, and a first engaging recess is formed on the inner surface of the first engaging portion at the position corresponding to the coupling protrude, and two abutting surfaces are formed at two lateral ends of the first engaging recess respectively. A second engaging portion extended from the top of the first engaging portion is formed in parallel with the bottom of the first engaging recess. The lid comprises a second peripheral edge at the outer periphery thereof, and the inner surface of the second peripheral edge is configured to couple with and cover the first peripheral edge of the container. At least two first connecting portions respectively protrude from the second peripheral edge at symmetric positions, and at least two second connecting portions, which are located at symmetric positions, outwardly protrude from the second periphery edge respectively. The first connecting portions and the second connecting portions are adapted to be coupled with the first coupling portions and the second coupling portions respectively so as to complete positioning. A second engaging recess is formed on the surface of the first connecting portion, and the second engaging protrude of the first hinge portion is configured to engage with the second engaging recess, and the second engaging protrude is adapted to be separated through the first cutting broken line. When the first hinge portion is pulled down to detach from the first connecting portion of the lid, the second engaging protrude and the second engaging recess are not easy to detach from each other such that the second engaging protrude is separated from the first hinge portion through the first cutting broken line, and the second engaging protrude and the second engaging recess are still engaged together. Each of the second connecting portions has a fourth engaging protrude at the middle section thereof, and two locating recesses are respectively formed at two lateral sides of the fourth engaging protrude. Each of the fourth engaging protrudes is formed in a hollow shape to cover the coupling protrude, and the two locating recesses are positioned in the two coupling recesses respectively. Each of the fourth engaging protrudes has a third coupling portion upwardly extending from the top and along the outside surface of fourth engaging protrude, and each of first recesses is formed between the third coupling portion and the second peripheral edge.

In one embodiment, each of the first coupling portions has an abutting protrude at the middle section thereof, and each of the abutting protrudes comprises an arc locating surface on the surface thereof, and each of the first connecting portions comprises a first surface protruding from the surface thereof, and a hollow housing is formed inside the first connecting portion; the second engaging recess, which is formed in tapered cylindrical and has a gradually larger diameter from the first surface toward the inside of the housing, is formed on the first surface, and the second engaging protrude is formed in a tapered cylindrical shape gradually expanding upward from the surface of the first hinge portion.

In another embodiment, a recessed locating space is formed on the middle portion of the first coupling portion of the container, and an inclined surface is downwardly extending from the end of the first connecting portion, and the second engaging recess, which is formed in a tapered shape from top to bottom, is formed on the inclined surface, and the second engaging protrude is formed in a tapered cylindrical shape gradually expanding upward from the surface of the first hinge portion.

In a further embodiment, the second engaging protrude is formed in a tapered cylindrical shape gradually expanding upward from the surface of the first hinge portion, and the second engaging recess is formed in the shape corresponding to the second engaging protrude.

In still a further embodiment, a plurality of horizontal reinforced structures are formed respectively on the outer surface of the fourth engaging protrude and the outer surface of the third coupling portion.

Comparing with conventional locking mechanism for container and lid thereof, the present invention is advantageous because: (i) with the design of the first cutting broken line, the user can easily tell whether the lid is opened so as to avoid the food inside the container from touch by the intentional person; and (ii) although the second engaging protrude cannot be reused, the user can use the first engaging portion and the fourth engaging protrude to achieve the engagement between the container and the lid; and (iii) with the second engaging portion and the third coupling portion, the engagement between the container and the lid is secured so as to prevent the lid from detaching from the container when the container or the lid is pressed.

DETAILED DESCRIPTION OF THE INVENTION

Figure 1:
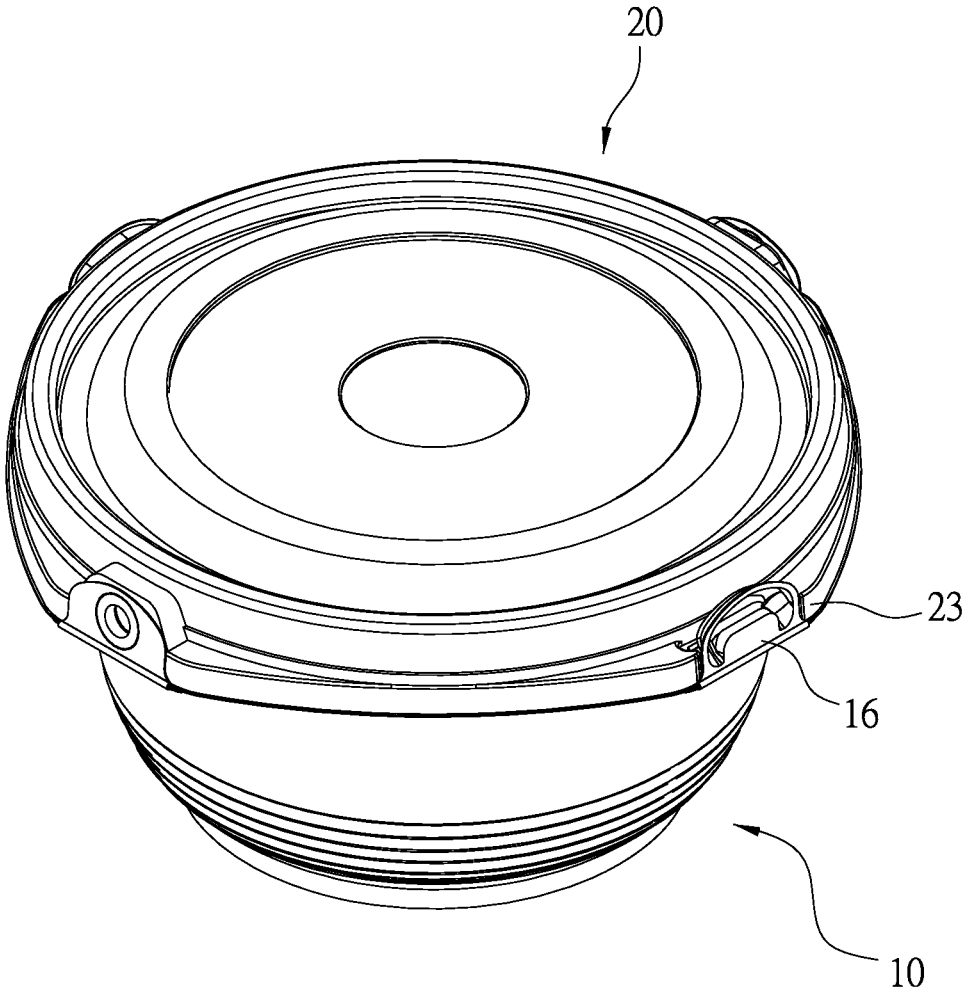
FIG. 1 is a three-dimensional assembly view of a locking mechanism for container and lid thereof of the present invention.
Figure 2:
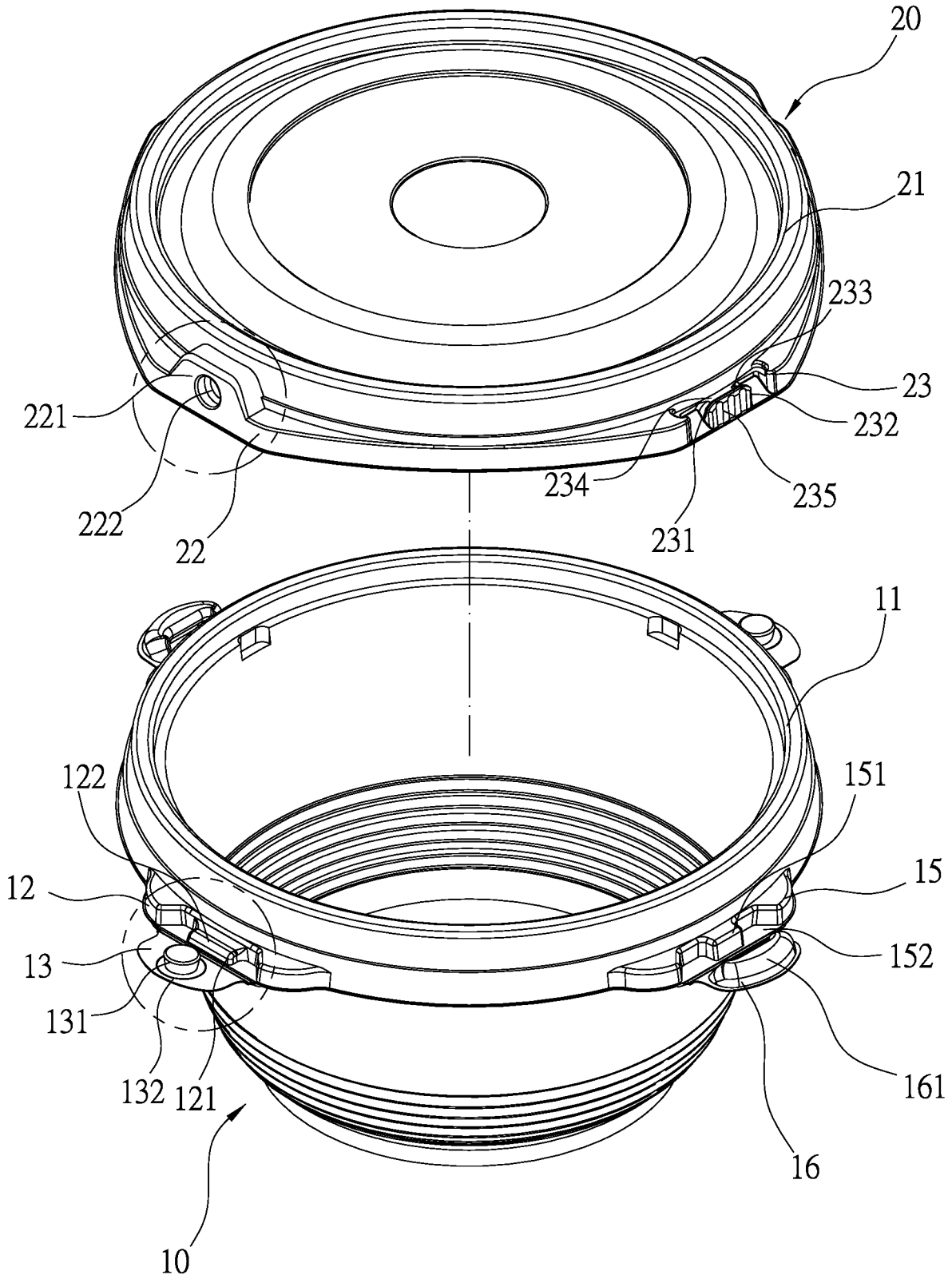
FIG. 2 is a three-dimensional exploded view of the locking mechanism for container and lid thereof of the present invention.
Figure 3:
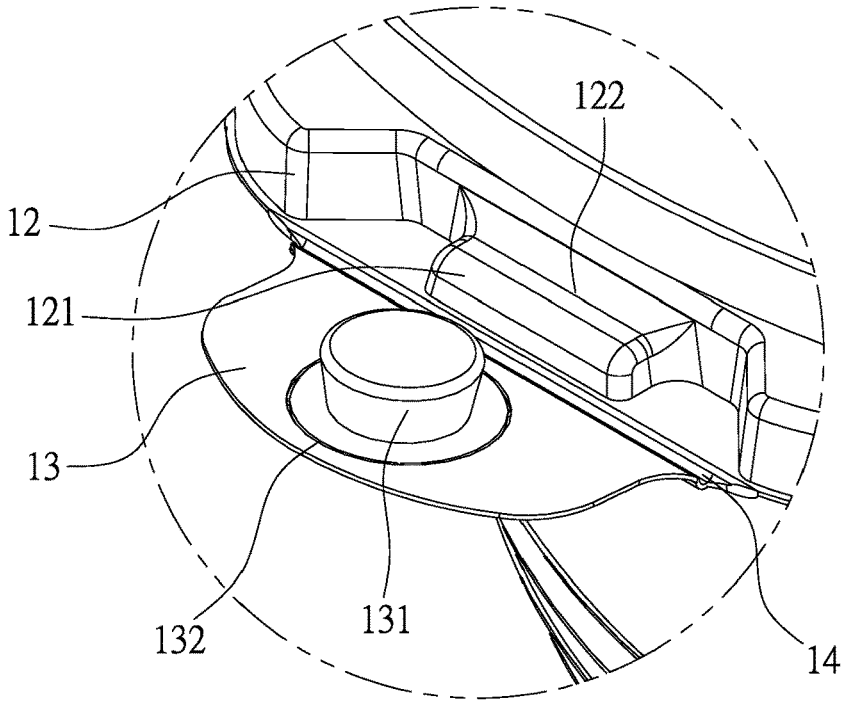
FIG. 3 is a detailed enlarged schematic view of a first coupling portion of the present invention in FIG. 2.
Figure 4:
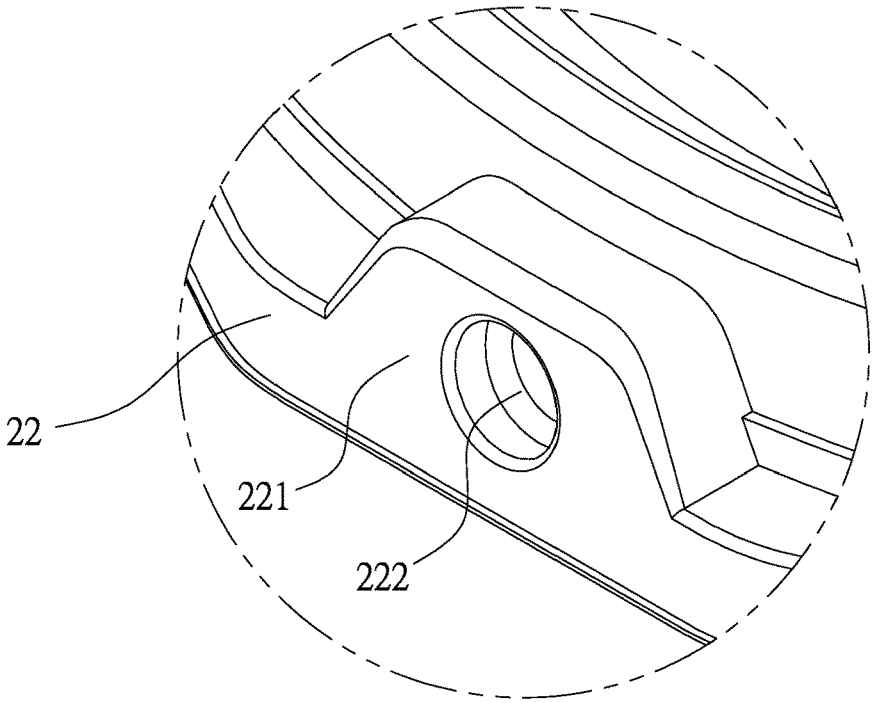
FIG. 4 is a detailed enlarged schematic view of a first connecting portion of the present invention in FIG. 2.

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

In order to further understand the goal, characteristics and effect of the present invention, a number of embodiments along with the drawings are illustrated as following:

Referring to FIGS. 1 to 4, the present invention provides a locking mechanism for container and lid thereof comprising a container (10) and a lid (20), and the peripheral edge of the upper opening of the container (10) has a first periphery edge (11). At least two first coupling portions (12), which are located at symmetric positions, outwardly protrude from the first periphery edge (11) respectively, and each of the first coupling portions (12) has an abutting protrude (121) at the middle section thereof, and each of the abutting protrudes (121) comprises an arc locating surface (122) on the surface thereof. Also, the outer edge of the first coupling portion (12) has a first hinge portion (13), and a first bending portion (14) is formed between the first coupling portion (12) and the first hinge portion (13). Furthermore, the first hinge portion (13) comprises a second engaging protrude (131) on the surface thereof, and a first cutting broken line (132) is formed on the first hinge portion (13) around the outer periphery of the second engaging protrude (131). The lid (20) comprises a second peripheral edge (21) at the outer periphery thereof, and the inner surface of the second peripheral edge (21) is configured to couple with and cover the first peripheral edge (11) of the container (10), and at least two first connecting portions (22) respectively protrude from the second peripheral edge (21) at symmetric positions, and the first connecting portions (22) are adapted to be coupled with the first coupling portions (12) so as to complete positioning. Each of the first connecting portions (22) comprises a first surface (221) protruding from the surface thereof, and a hollow housing (not shown in FIGs) is formed inside the first connecting portion (22), and a tapered cylindrical second engaging recess (222) which has a gradually larger diameter from the first surface (221) toward the inside of the housing is formed on the first surface (221). In addition, the second engaging protrude (131) of the first hinge portion (13) is configured to engage with the second engaging recess (222), and the second engaging protrude (131) is adapted to be separated through the first cutting broken line (132).

Figure 5:
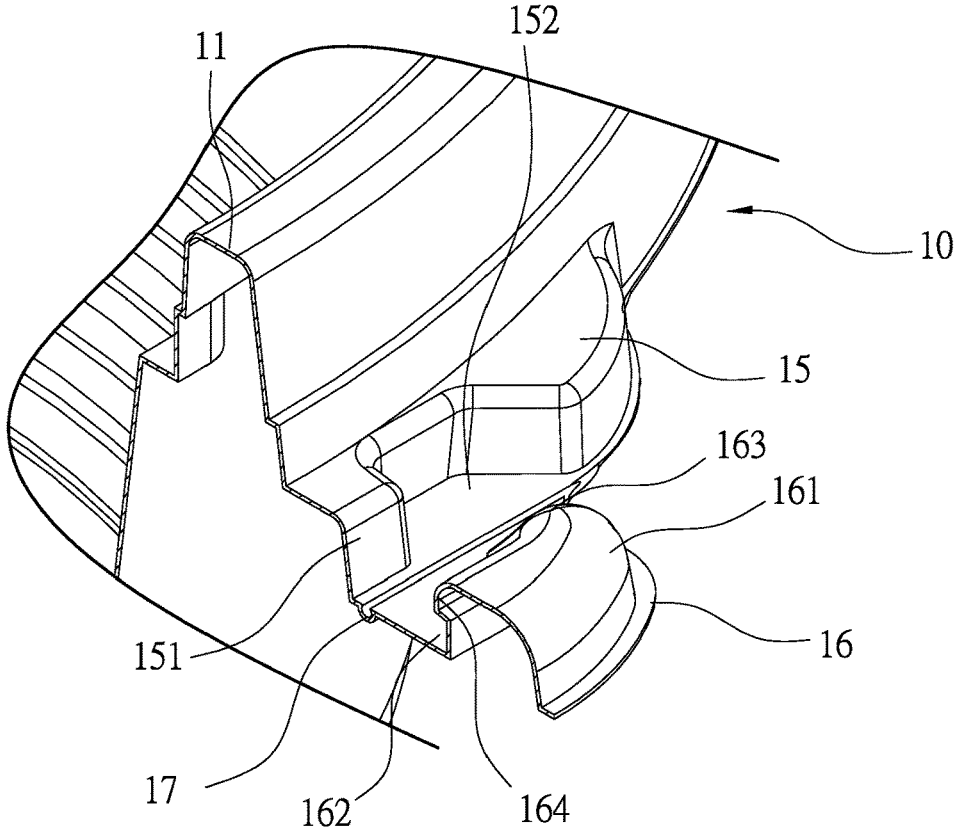
FIG. 5 is a detailed enlarged schematic view of a second coupling portion of the present invention.
Figure 6:
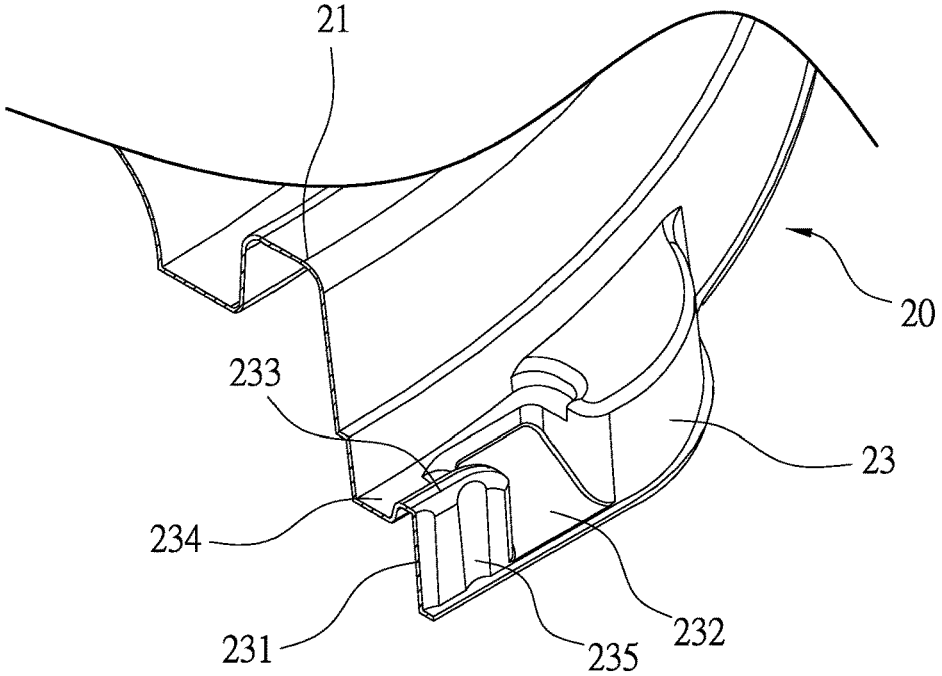
FIG. 6 is a detailed enlarged schematic view of a second connecting portion of the present invention.
Figure 7:
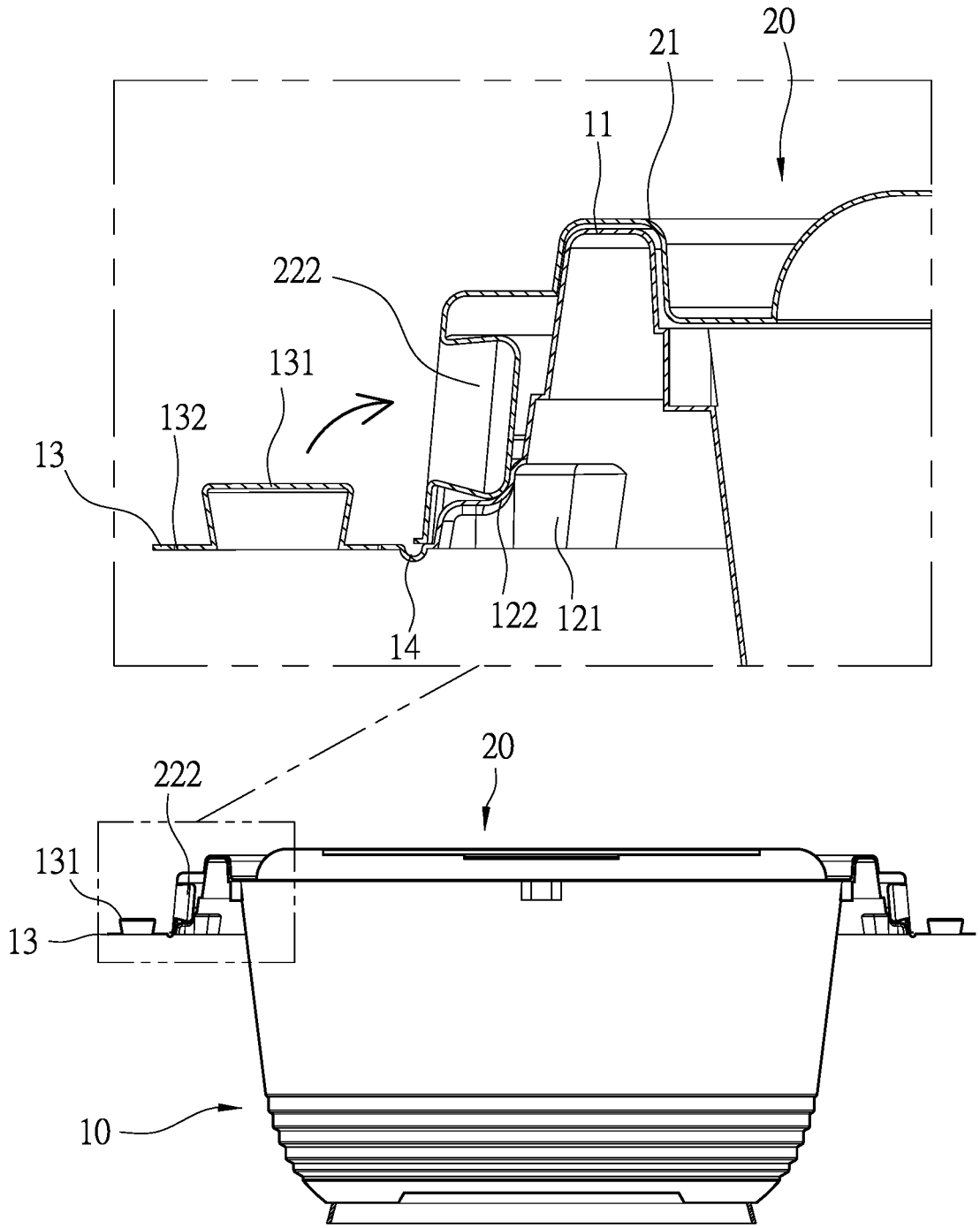
FIG. 7 is a sectional schematic view illustrating the first coupling portion and the first connecting portion are coupled together in the present invention.
Figure 8:
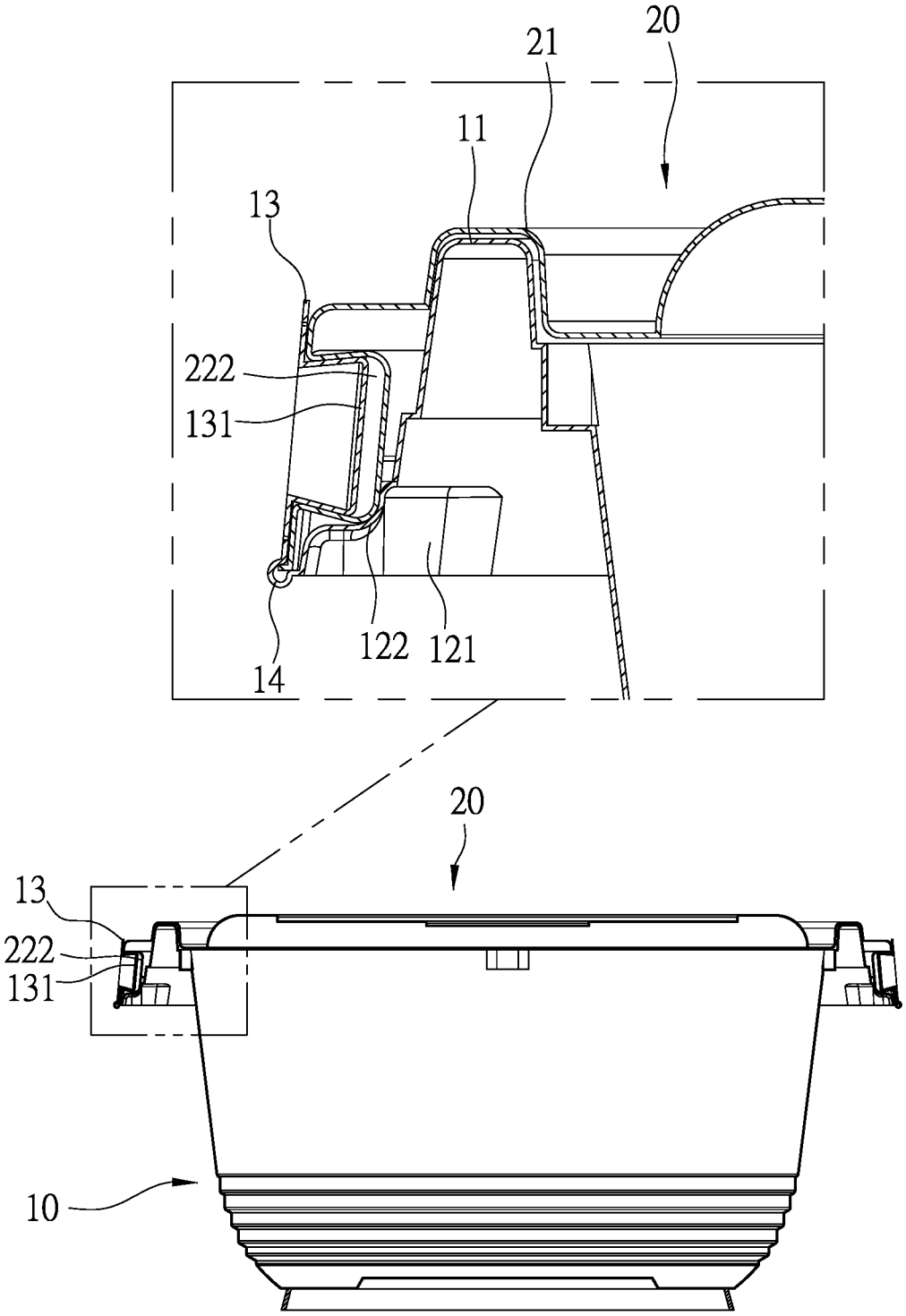
FIG. 8 is a sectional schematic view illustrating a first hinge portion of the present invention is engaged with the first connecting portion.
Figure 9:
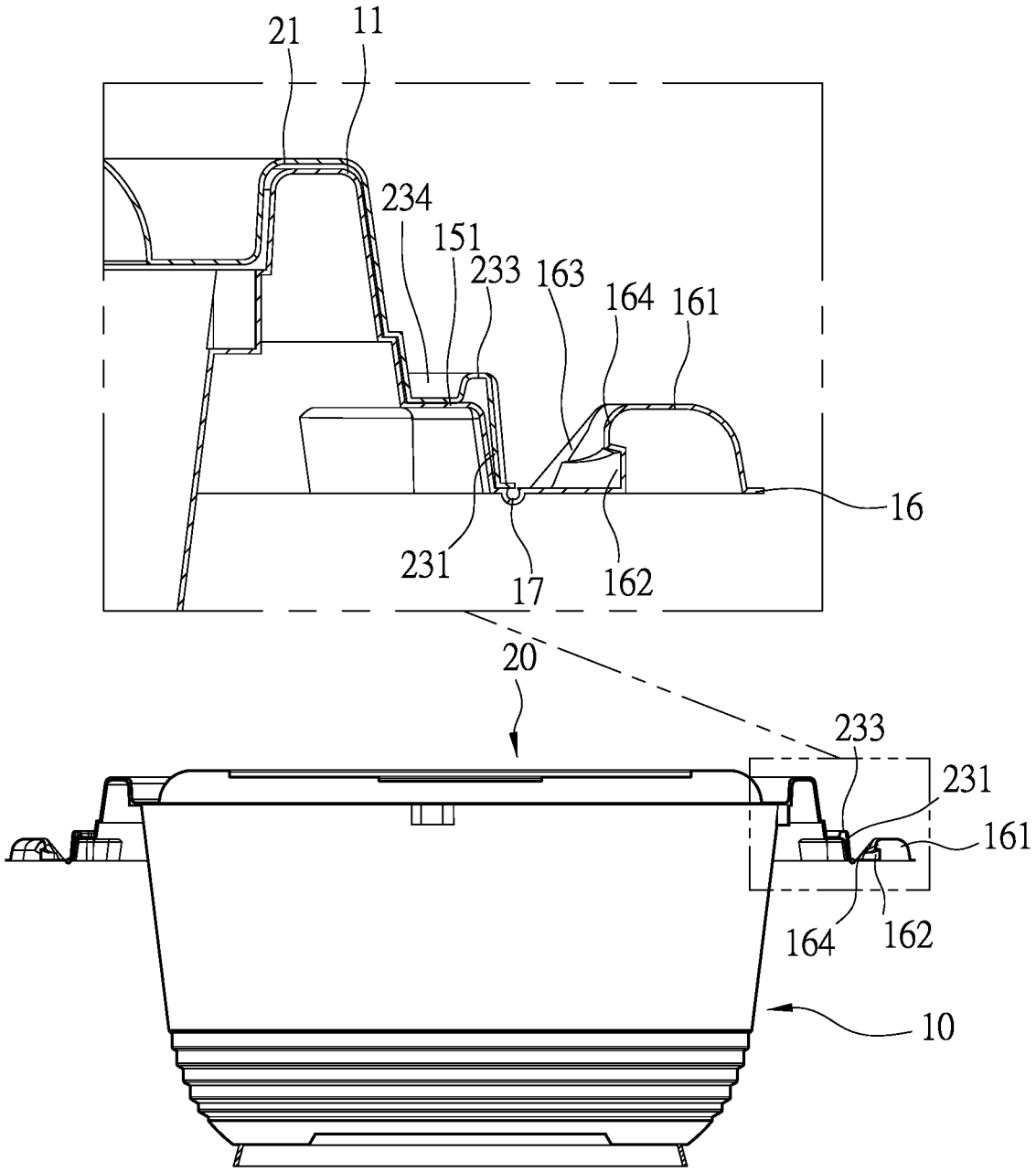
FIG. 9 is a sectional schematic view illustrating the second coupling portion and the second connecting portion are coupled together in the present invention.
Figure 10:
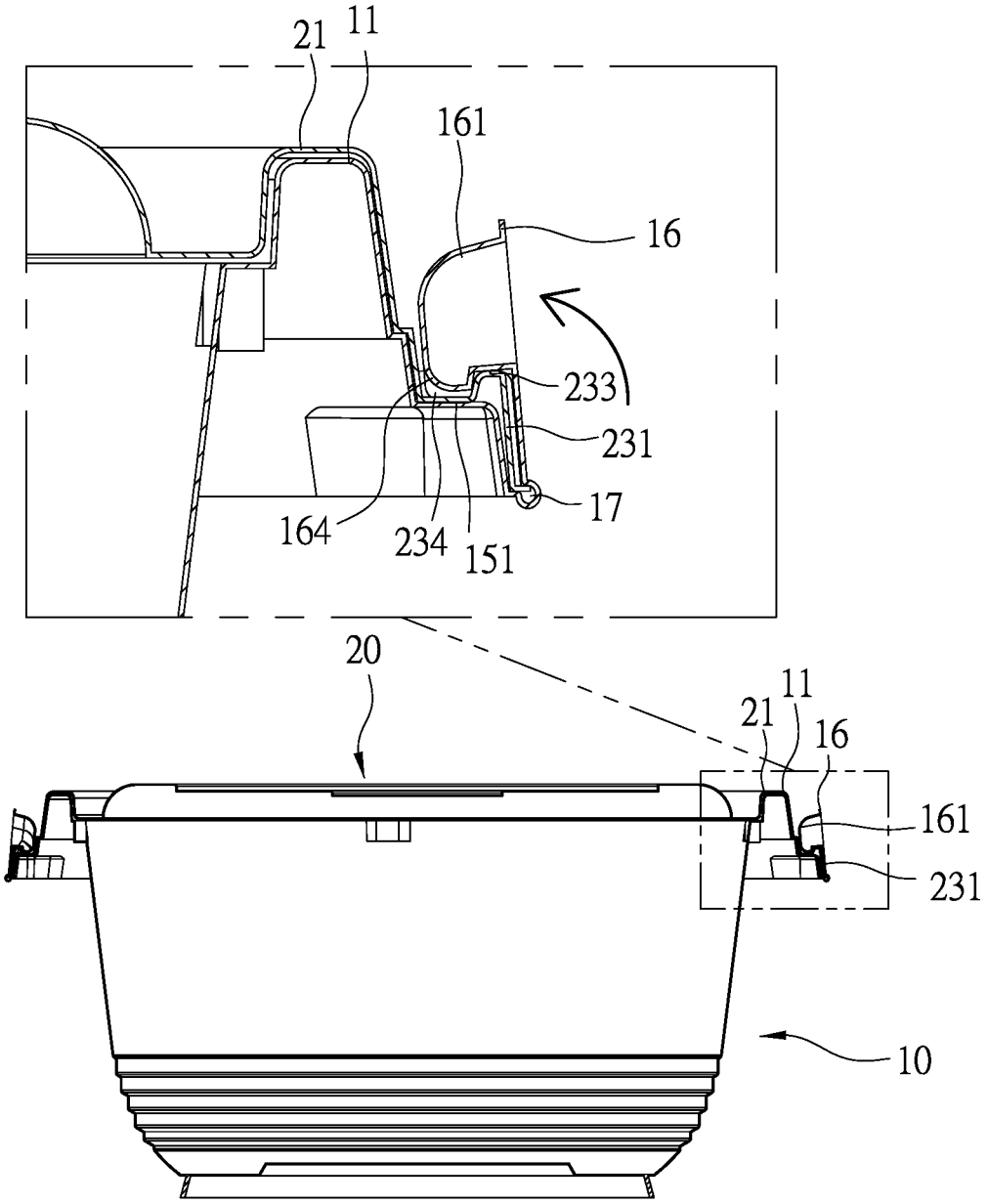
FIG. 10 is a sectional schematic view illustrating a second hinge portion of the present invention is engaged with the second connecting portion.

Referring to FIGS. 5 and 6, at least two second coupling portions (15), which are located at symmetric positions, outwardly protrude from the first periphery edge (11) respectively, and each of the second coupling portions (15) has a second hinge portion (16) formed at the outer edge thereof, and a second bending portion (17) is formed between the second coupling portion (15) and the second hinge portion (16). Also, each of the second coupling portions (15) comprises a coupling protrude (151) at the middle section thereof, and two coupling recesses (152) are respectively formed at two lateral sides of the coupling protrude (151). Moreover, each of the second hinge portions (16) has a first engaging portion (161) protruding from the surface thereof, and a first engaging recess (162) is formed on the inner surface of the first engaging portion (161) at the position corresponding to the coupling protrude (151), and two abutting surfaces (163) are formed at two lateral ends of the first engaging recess (162) respectively. A second engaging portion (164) extended from the top of the first engaging portion (161) is formed in parallel with the bottom of the first engaging recess (162). At least two second connecting portions (23), which are located at symmetric positions, outwardly protrude from the second periphery edge (21) respectively, and the second connecting portions (23) are configured to be coupled with the second coupling portions (15) so as to complete positioning. Each of the second connecting portions (23) has a fourth engaging protrude (231) at the middle section thereof, and two locating recesses (232) are respectively formed at two lateral sides of the fourth engaging protrude (231). In addition, each of the fourth engaging protrudes (231) is formed in a hollow shape to cover the coupling protrude (151), and the two locating recesses (232) are positioned in the two coupling recesses (152) respectively. Furthermore, each of the fourth engaging protrudes (231) has a third coupling portion (233) upwardly extending from the top and along the outside surface of fourth engaging protrude (231), and each of first recesses (234) is formed between the third coupling portion (233) and the second peripheral edge (21), and a plurality of horizontal reinforced structures are formed respectively on the outer surface of the fourth engaging protrude (231) and the outer surface of the third coupling portion (233).

Structurally, referring to FIGS. 1 and 7 to 10, the second peripheral edge (21) of the lid (20) is adapted to couple and cover the first peripheral edge (11) of the container (10), and the first connecting portions (22) and the second connecting portions (23) are configured to couple and cover the first coupling portions (12) and the second coupling portions (15) respectively, so as to position the lid (20) on the opening of the container (10). Also, when the first connecting portion (22) is coupled with the first coupling portion (12), the inner edge of the second engaging recess (222) is coupled with the arc locating surface (122) of the abutting protrude (121) to complete positioning. Then, the first hinge portion (13) of the first coupling portion (12) is adapted to flip up, and the second engaging protrude (131) is engaged in the second engaging recess (222) of the first connecting portion (22). Furthermore, the tapered-shape design of the second engaging protrude (131) and the second engaging recess (222) provides the firm engagement structure between the lid (20) and the container (10). Also, the first hinge portion (13) is coupled on the first surface (221), and as the second connecting portion (23) is coupled on the second coupling portion (15), the fourth engaging protrude (231) is adapted to abut against and cover the coupling protrude (151), and the coupling protrude (151) is configured to abut against the bottom surface of the first recess (234) of the fourth engaging protrude (231), so as to improve the structural strength of the fourth engaging protrude (231). Thereafter, the second hinge portion (16) is configured to flip up to couple with the lid (20), and the first engaging portion (161) is engaged with the fourth engaging protrude (231) of the second connecting portion (23). Moreover, the first engaging recess (162) of the first engaging portion (161) is engaged with the fourth engaging protrude (231), and the second engaging portion (164) of the first engaging portion (161) is configured to narrow the opening area of the first engaging recess (162), and the third coupling portion (233) of the fourth engaging protrude (231) is engaged with the second engaging portion (164), so that the second hinge portion (16) needs to be pushed to enable the second engaging portion (164) to pass through the third coupling portion (233). Additionally, the first engaging recess (162) is coupled on the fourth engaging protrude (231), and the second engaging portion (164) is engaged with the third coupling portion (233) and is positioned in the first recess (234), and the two abutting surfaces (163) on the two ends of the first engaging recess (162) are adapted to be respectively abutted in the two locating recesses (232) at the two lateral sides of the fourth engaging protrude (231). Also, the edges of the second hinge portion (16) and the second coupling portions (15) are aligned so as to firmly engage the second hinge portion (16) and the fourth engaging protrude (231) together and to prevent the lid (20) from separating from the container (10) when the container (10) is moved.

Figure 11:
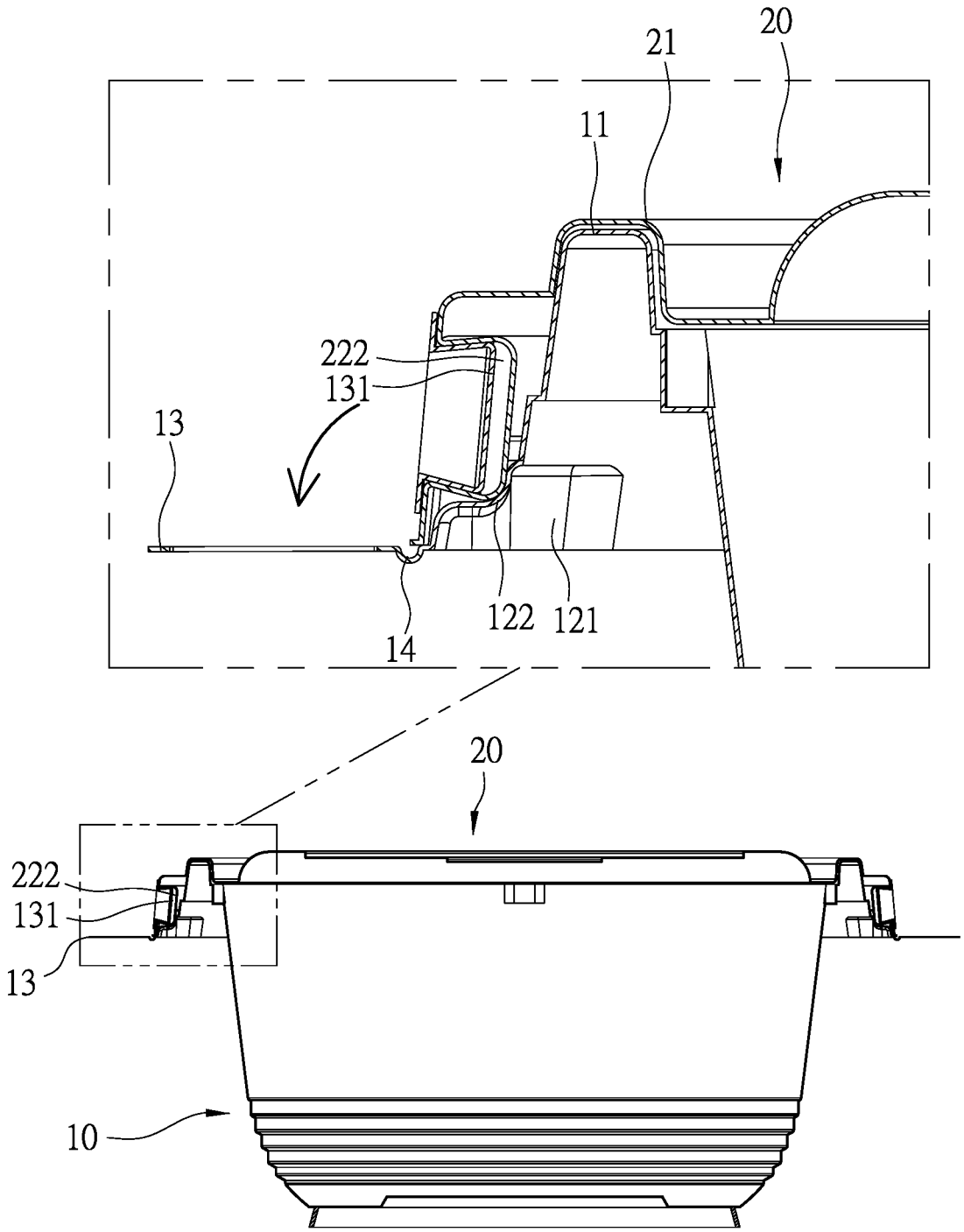
FIG. 11 is a sectional schematic view illustrating the hinge portion is detached from the second connecting portion in the present invention.
Figure 12:
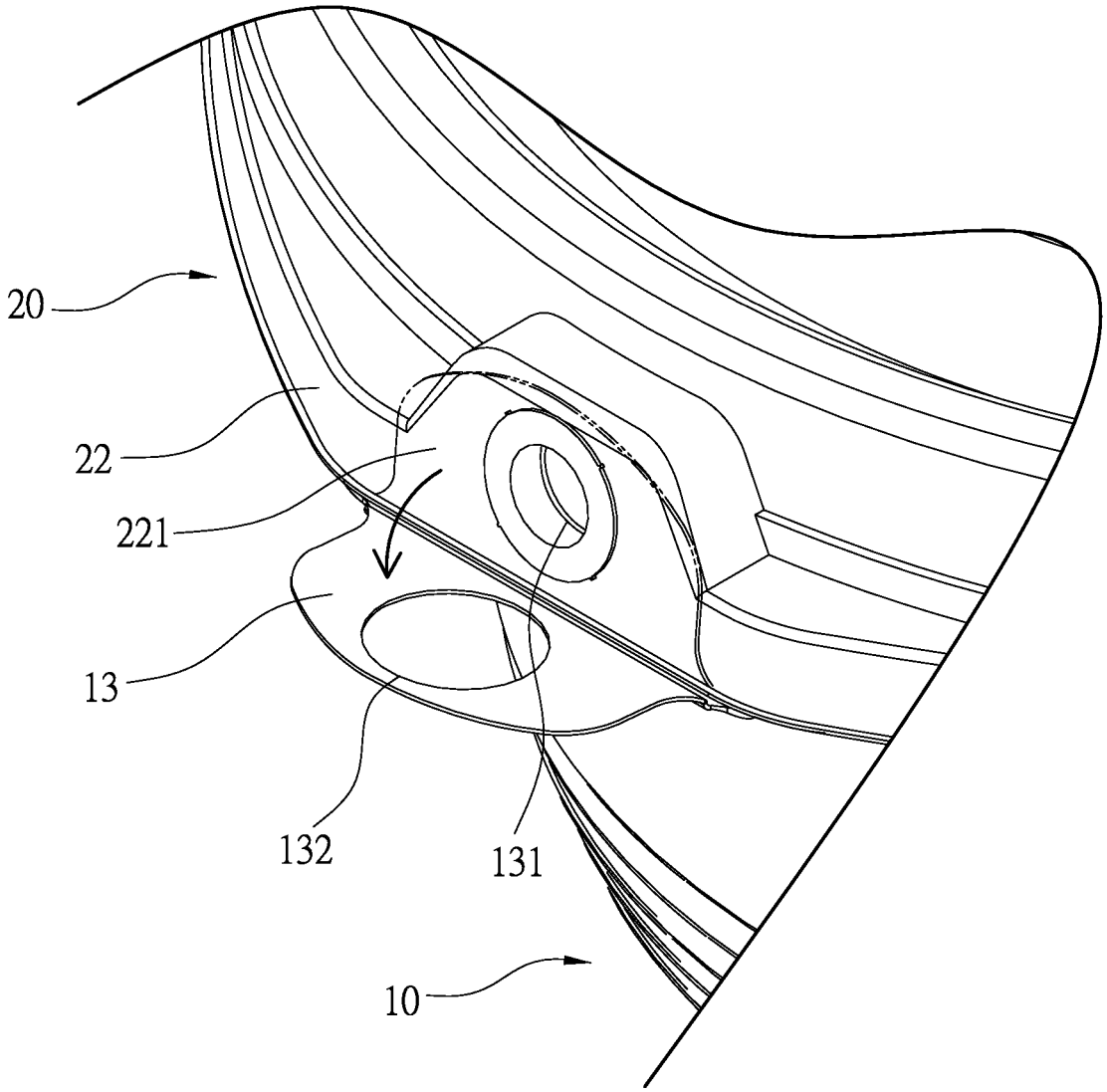
FIG. 12 is a detailed enlarged schematic view illustrating the hinge portion is detached from the second connecting portion in the present invention.

Referring to FIGS. 11 and 12, with the tapered-shape design of the second engaging protrude (131) and the second engaging recess (222), when the first hinge portion (13) is pulled down to detach from the first connecting portion (22) of the lid (20), the second engaging protrude (131) and the second engaging recess (222) are not easy to detach from each other such that the second engaging protrude (131) is separated from the first hinge portion (13) through the first cutting broken line (132), and the second engaging protrude (131) and the second engaging recess (222) are still engaged together. Thus, the first hinge portion (13) cannot be engaged with the lid (20) such that the user can tell whether the lid (20) is opened by intentional person through the connection between the first hinge portion (13) and the second engaging protrude (131).

Moreover, in case that the second hinge portion (16) of the second coupling portion (15) is pulled and detached from the fourth engaging protrude (231) so as to detach the lid (20) from the container (10), an extra force is needed to disengage the second engaging portion (164) with the third coupling portion (233). Also, the fourth engaging protrude (231) and the reinforced structure (235) of the third coupling portion (233) are adapted to ensure the structural strength of the third coupling portion (233) under normal repeated operation. Thus, the service life of the fourth engaging protrude (231), the lid (20) and the container (10) is prolonged so as to achieve the environmental protection effect.

Figure 13:
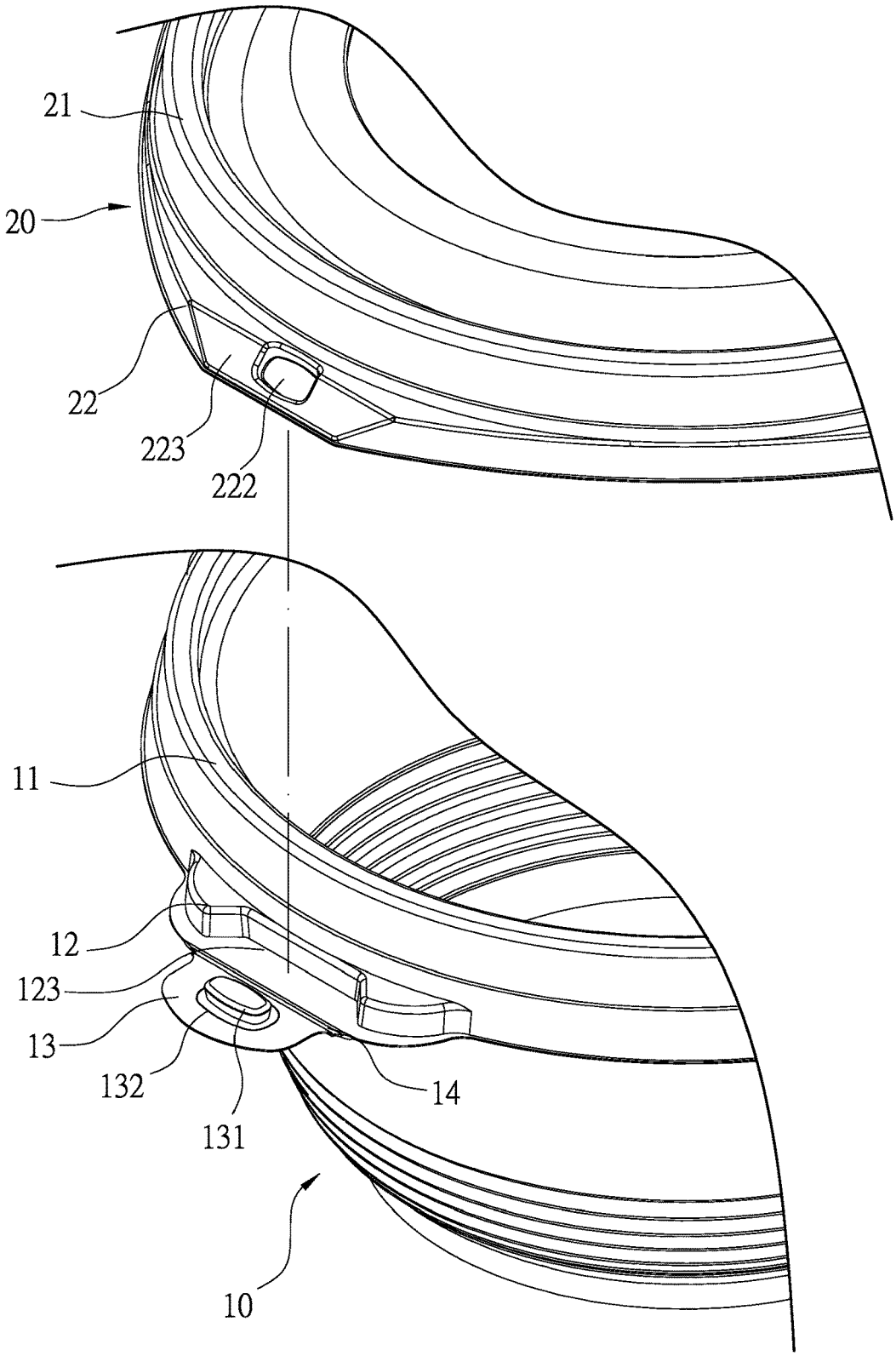
FIG. 13 is a three-dimensional exploded view of a second embodiment of the locking mechanism for container and lid thereof of the present invention.
Figure 14:
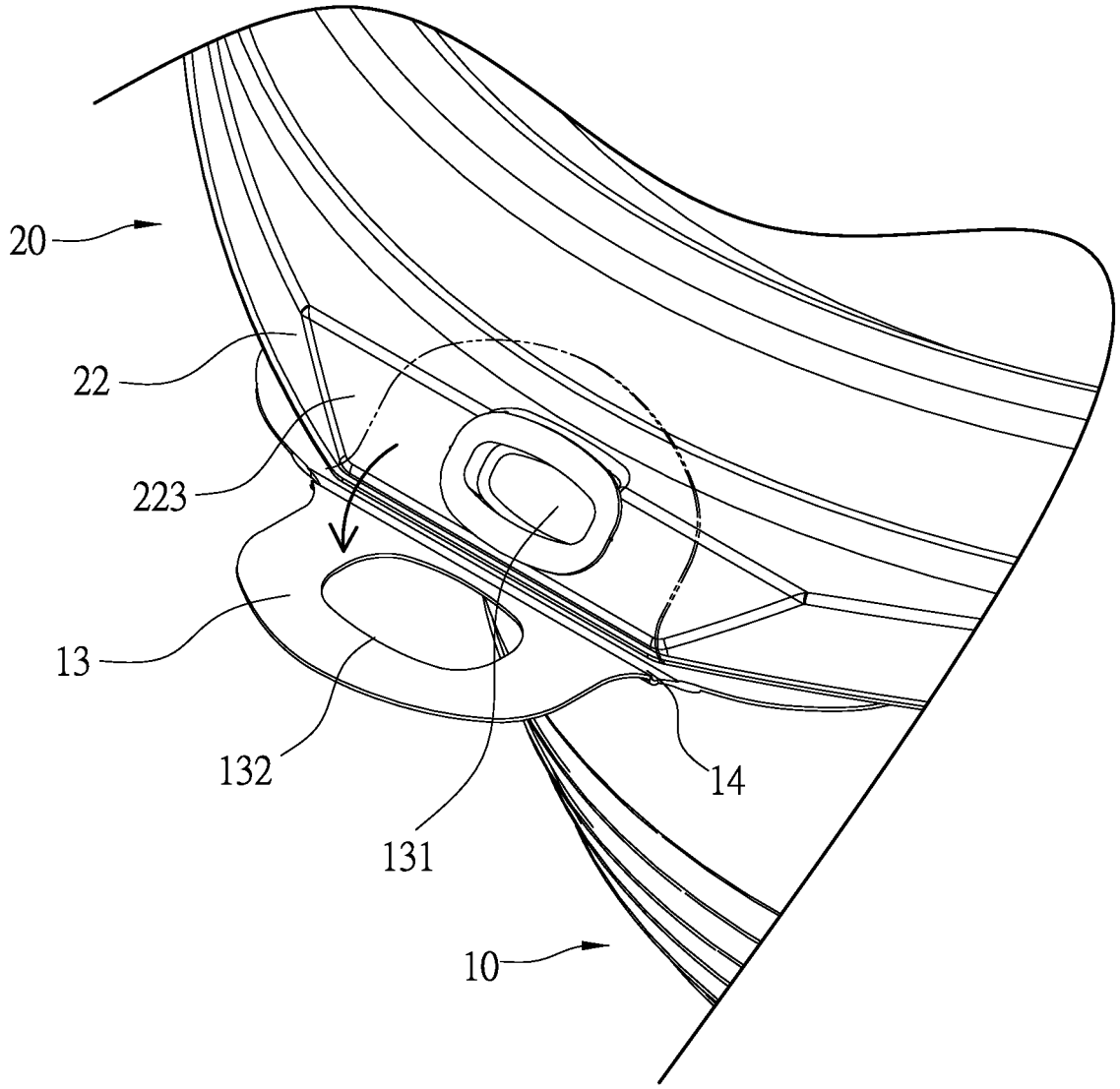
FIG. 14 is a schematic view of the second embodiment of the locking mechanism for container and lid thereof of the present invention.

In one embodiment, referring to FIGS. 13 and 14, a recessed locating space (123) is formed on the middle portion of the first coupling portion (12) of the container (10), and an inclined surface (223) is downwardly extending from the end of the first connecting portion (22), and the second engaging recess (222), which is formed in a tapered shape from top to bottom, is formed on the inclined surface (223), so that when the lid (20) is coupled with the container (10), the outer periphery of the second engaging recess (222) which protrudes from the inner side of the lid (20) is adapted to be received in the locating space (123) of the first coupling portion (12), and the second engaging protrude (131) of the first hinge portion (13) is engaged with the second engaging recess (222).

In another embodiment, the second engaging protrude (131) is formed in a tapered cylindrical shape gradually expanding upward from the surface of the first hinge portion (13), and the second engaging recess (222) is formed in the shape corresponding to the second engaging protrude (131).

Figure 15:
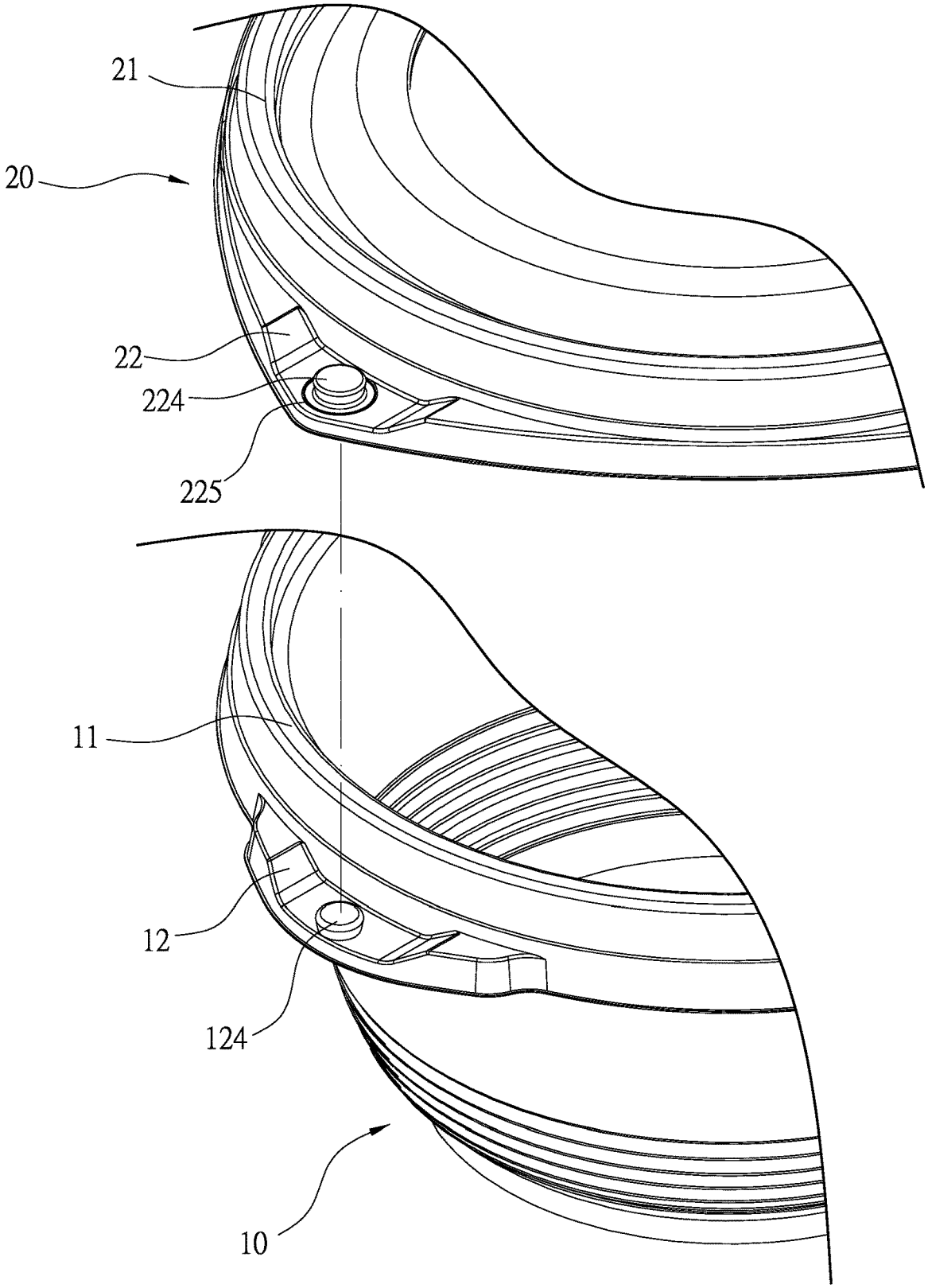
FIG. 15 is a three-dimensional exploded view of a third embodiment of the locking mechanism for container and lid thereof of the present invention.
Figure 16:
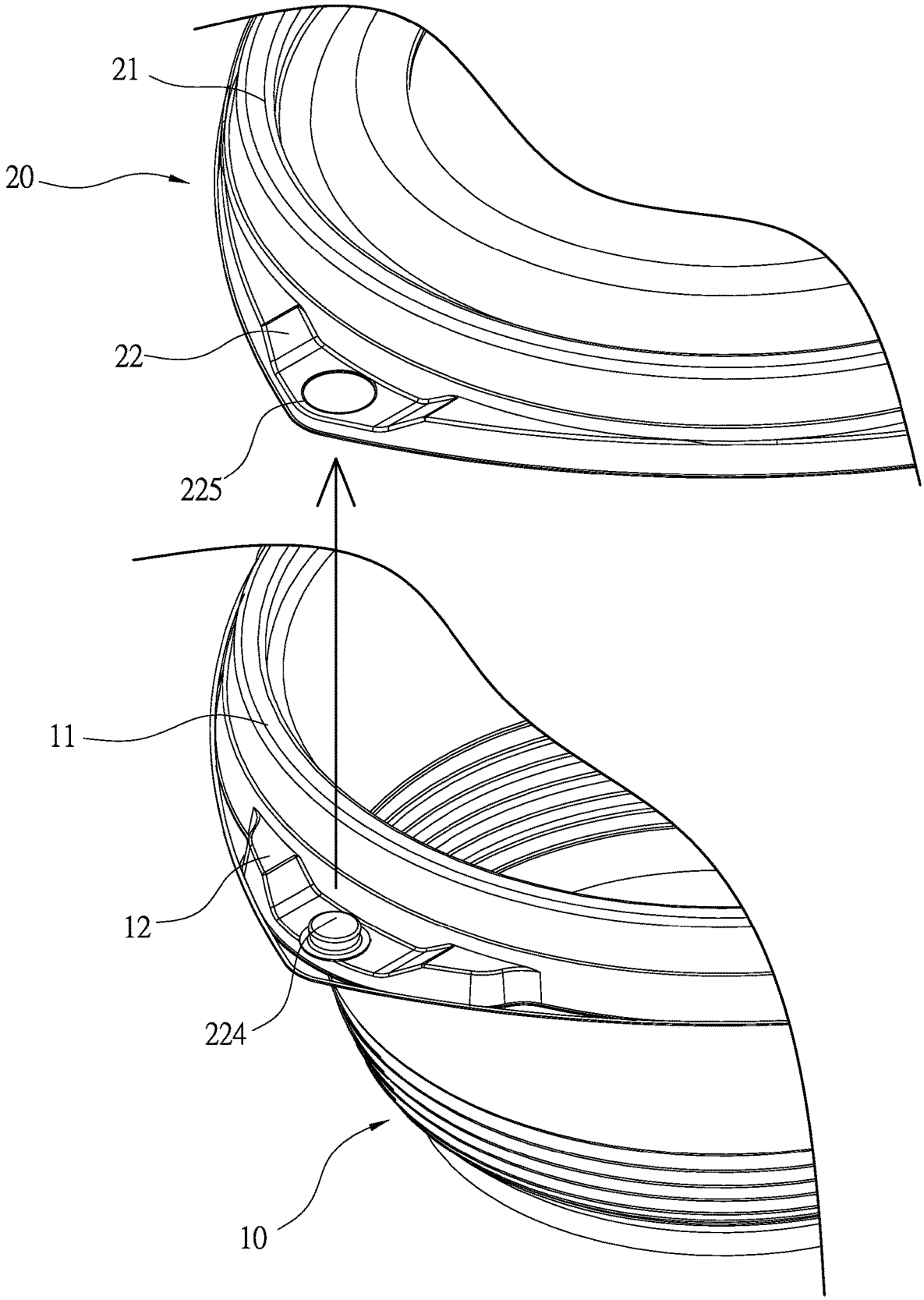
FIG. 16 is a schematic view of the third embodiment of the locking mechanism for container and lid thereof of the present invention.

In still another embodiment, referring to FIGS. 15 and 16, a first engaging protrude (124) is formed on the surface of the first coupling portion (12) of the container (10), and the surface of the first connecting portion (22) of the lid (20) has a hollow third engaging protrude (224), and a second cutting broken line (225) is formed on the periphery of the third engaging protrude (224) on the surface of the first connecting portion (22). When the lid (20) is coupled on the container (10) and the first connecting portions (22) are coupled with the first coupling portions (12), the third engaging protrude (224) is adapted to downwardly engage on the outer side of the first engaging protrude (124) of the first coupling portion (12), and the third engaging protrude (24) is configured to be separated through the second cutting broken line (225). When the first connecting portion (22) is detached from the first coupling portion (12), the first connecting portion (22) is separated with the third engaging protrude (224) through the second cutting broken line (225), and the third engaging protrude (224) is configured to keep engaging with the first engaging protrude (124) such that the user is adapted to tell whether the lid (20) is opened through the connection between the first connecting portion (22) and the third engaging protrude (224), thereby avoiding the food inside the container (10) from touch by the intentional person.

Comparing with conventional locking mechanism for container and lid thereof, the present invention is advantageous because: (i) with the design of the first cutting broken line (132) and the second cutting broken line (225), the user can easily tell whether the lid (20) is opened so as to avoid the food inside the container (10) from touch by the intentional person; and (ii) although the second engaging protrude (131) and the third engaging protrude (224) cannot be reused, the user can use the first engaging portion (161) and the fourth engaging protrude (231) to achieve the engagement between the container (10) and the lid (20); and (iii) with the second engaging portion (164) and the third coupling portion (233), the engagement between the container (10) and the lid (20) is secured so as to prevent the lid (20) from detaching from the container (10) when the container (10) or the lid (20) is pressed.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A locking mechanism for container and lid thereof comprising a container and a lid;

wherein the container has a first periphery edge has the peripheral edge of the upper opening thereof, and at least two first coupling portions, which are located at symmetric positions, and at least two second coupling portions, which are located at symmetric positions, outwardly protrude from the first periphery edge respectively; an outer edge of each of the first coupling portion has a first hinge portion, and a first bending portion is formed between each of the first coupling portion and the first hinge portion; the first hinge portion comprises a second engaging protrude on a surface thereof, and a first cutting broken line is formed on the first hinge portion around the outer periphery of the second engaging protrude; each of the second coupling portions has a second hinge portion formed at the outer edge thereof, and a second bending portion is formed between the second coupling portion and the second hinge portion; each of the second coupling portions comprises a coupling protrude at the middle section thereof, and two coupling recesses are respectively formed at two lateral sides of the coupling protrude; each of the second hinge portions has a first engaging portion protruding from the surface thereof, and a first engaging recess is formed on an inner surface of the first engaging portion at the position corresponding to the coupling protrude, and two abutting surfaces are formed at two lateral ends of the first engaging recess respectively; a second engaging portion extended from the top of the first engaging portion is formed in parallel with the bottom of the first engaging recess; and wherein the lid comprises a second peripheral edge at the outer periphery thereof, and an inner surface of the second peripheral edge is configured to couple with and cover the first peripheral edge of the container; at least two first connecting portions respectively protrude from the second peripheral edge at symmetric positions, and at least two second connecting portions, which are located at symmetric positions, outwardly protrude from the second periphery edge respectively; the first connecting portions and the second connecting portions are adapted to be coupled with the first coupling portions and the second coupling portions respectively so as to complete positioning; a second engaging recess is formed on the surface of the first connecting portion, and the second engaging protrude of the first hinge portion is configured to engage with the second engaging recess, and the second engaging protrude is adapted to be separated through the first cutting broken line; when the first hinge portion is pulled down to detach from the first connecting portion of the lid, the second engaging protrude is separated from the first hinge portion through the first cutting broken line, and the second engaging protrude and the second engaging recess are still engaged together; each of the second connecting portions has a fourth engaging protrude at the middle section thereof, and two locating recesses are respectively formed at two lateral sides of the fourth engaging protrude; each of the fourth engaging protrudes is formed in a hollow shape to cover the coupling protrude, and the two locating recesses are positioned in the two coupling recesses respectively; each of the fourth engaging protrudes has a third coupling portion upwardly extending from the top and along the outside surface of fourth engaging protrude, and each of first recesses is formed between the third coupling portion and the second peripheral edge.

2. The locking mechanism for container and lid thereof of claim 1, wherein each of the first coupling portions has an abutting protrude at the middle section thereof, and each of the abutting protrudes comprises an arc locating surface on the surface thereof, and each of the first connecting portions comprises a first surface protruding from the surface thereof, and a hollow housing is formed inside the first connecting portion; the second engaging recess, which is formed in tapered cylindrical and has a gradually larger diameter from the first surface toward the inside of the housing, is formed on the first surface, and the second engaging protrude is formed in a tapered cylindrical shape gradually expanding upward from the surface of the first hinge portion.

3. The locking mechanism for container and lid thereof of claim 1, wherein a recessed locating space is formed on the middle portion of the first coupling portion of the container, and an inclined surface is downwardly extending from the end of the first connecting portion, and the second engaging recess, which is formed in a tapered shape from top to bottom, is formed on the inclined surface, and the second engaging protrude is formed in a tapered cylindrical shape gradually expanding upward from the surface of the first hinge portion.

4. The locking mechanism for container and lid thereof of claim 3, wherein the second engaging protrude is formed in a tapered cylindrical shape gradually expanding upward from the surface of the first hinge portion, and the second engaging recess is formed in the shape corresponding to the second engaging protrude.

5. The locking mechanism for container and lid thereof of claim 1, wherein a plurality of horizontal reinforced structures are formed respectively on the outer surface of the fourth engaging protrude and the outer surface of the third coupling portion.

6. A locking mechanism for container and lid thereof comprising a container and a lid;

wherein the container has a first periphery edge has the peripheral edge of the upper opening thereof, and at least two first coupling portions, which are located at symmetric positions, and at least two second coupling portions, which are located at symmetric positions, outwardly protrude from the first periphery edge respectively; a first engaging protrude is formed on a surface of each of the first coupling portion; each of the second coupling portions has a second hinge portion formed at the outer edge thereof, and a second bending portion is formed between the second coupling portion and the second hinge portion; each of the second coupling portions comprises a coupling protrude at the middle section thereof, and two coupling recesses are respectively formed at two lateral sides of the coupling protrude; each of the second hinge portions has a first engaging portion protruding from the surface thereof, and a first engaging recess is formed on an inner surface of the first engaging portion at the position corresponding to the coupling protrude, and two abutting surfaces are formed at two lateral ends of the first engaging recess respectively; a second engaging portion extended from the top of the first engaging portion is formed in parallel with the bottom of the first engaging recess;

wherein the lid comprises a second peripheral edge at the outer periphery thereof, and an inner surface of the second peripheral edge is configured to couple with and cover the first peripheral edge of the container; at least two first connecting portions and at least two second connecting portions respectively protrude from the second peripheral edge; the first connecting portions and the second connecting portions are adapted to be coupled with the first coupling portions and the second coupling portions respectively so as to complete positioning; the surface of the first connecting portion of the lid has a hollow third engaging protrude, and a second cutting broken line is formed on the periphery of the third engaging protrude on the surface of the first connecting portion; when the lid is coupled on the container and the first connecting portion is coupled with the first coupling portion, the third engaging protrude is adapted to downwardly engage on the outer side of the first engaging protrude of the first coupling portion, and the third engaging protrude is configured to be separated through the second cutting broken line; when the first connecting portion is detached from the first coupling portion, the first connecting portion is separated with the third engaging protrude through the second cutting broken line, and the third engaging protrude is configured to keep engaging with the first engaging protrude; each of the second connecting portions has a fourth engaging protrude at the middle section thereof, and two locating recesses are respectively formed at two lateral sides of the fourth engaging protrude; each of the fourth engaging protrudes is formed in a hollow shape to cover the coupling protrude, and the two locating recesses are positioned in the two coupling recesses respectively; each of the fourth engaging protrudes has a third coupling portion upwardly extending from the top and along the outside surface of fourth engaging protrude, and each of first recesses is formed between the third coupling portion and the second peripheral edge.

7. The locking mechanism for container and lid thereof of claim 6, wherein the first engaging protrude is formed in a tapered cylindrical shape having the diameter upwardly gradually larger from the surface of the first coupling portion; the third engaging protrude is formed in tapered cylindrical shape having the diameter upwardly gradually larger from the surface of the first connecting portion.

8. The locking mechanism for container and lid thereof of claim 6, wherein a plurality of horizontal reinforced structures are formed respectively on the outer surface of the fourth engaging protrude and the outer surface of the third coupling portion.

* * * * *